US007922039B2

(12) United States Patent
Jablonski et al.

(10) Patent No.: US 7,922,039 B2
(45) Date of Patent: Apr. 12, 2011

(54) TOY WATER GUN WITH SELECTABLE PULSE AND STREAM DISCHARGE NOZZLES

(75) Inventors: Brian Jablonski, Providence, RI (US); Joseph Dobkin, Newton, MA (US); Raymond A. Mead, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 506 days.

(21) Appl. No.: 11/745,298

(22) Filed: May 7, 2007

(65) Prior Publication Data

US 2008/0277413 A1 Nov. 13, 2008

(51) Int. Cl.
*A63H 33/30* (2006.01)

(52) U.S. Cl. ..... 222/79; 222/401; 239/99; 446/475; 446/473

(58) Field of Classification Search ..... 222/79, 222/330, 331, 401; 239/99; 446/473, 475
See application file for complete search history.

(56) References Cited

U.S. PATENT DOCUMENTS 3,403,472 A 10/1968 De Rauchourt
4,204,462 A 5/1980 Richards et al.
4,205,785 A 6/1980 Stanley
4,214,674 A * 7/1980 Jones et al. ..... 222/79
4,217,931 A 8/1980 Jaekel
4,265,404 A 5/1981 Hunter
4,301,967 A 11/1981 Hunter
4,550,876 A 11/1985 Kulesza et al.
4,757,946 A * 7/1988 Johnson ..... 239/99
4,781,217 A 11/1988 Rosenberg
5,111,993 A 5/1992 Baker
5,141,132 A 8/1992 Whelan
5,366,108 A * 11/1994 Darling ..... 222/79
5,722,566 A 3/1998 Glynn
5,730,325 A 3/1998 Cheung
5,799,827 A * 9/1998 D'Andrade ..... 222/79
5,850,941 A 12/1998 Johnson et al.
6,026,851 A 2/2000 Rosenberg
(Continued)

OTHER PUBLICATIONS

Declaration of Colleen Cushing, dated Sep. 21, 2010 with Exhibits A and B (31 pages).

*Primary Examiner* — Kevin Shaver
*Assistant Examiner* — Jonathan Wood
(74) *Attorney, Agent, or Firm* — Miller, Matthias & Hull, LLP

(57) ABSTRACT

A toy gun is disclosed that may have a pressurized elastomeric supply bladder in fluid communication with an elastomeric pulse bladder via a trigger valve. The pulse bladder may also be in fluid communication with a pulse nozzle via a pulse valve that is operatively connected to the pulse bladder so that the pulse valve moves from a closed position to an open position when the pulse bladder expands. When the supply bladder is filled with pressurized liquid and the trigger valve is opened, pressurized liquid from the supply bladder is forced into the pulse bladder. As the pulse bladder expands, the expansion eventually causes the pulse valve to open and cause a burst of liquid to be discharged from the pulse bladder through the pulse nozzle. As the pulse bladder contracts during the burst of liquid, the pulse valve returns to the closed position so that the pulse bladder can continuously cycle through the sequence of filling with pressurized liquid and opening the pulse valve to release a burst of liquid as long as the trigger valve remains opened and the supply bladder forces pressurized liquid to the pulse bladder.

33 Claims, 13 Drawing Sheets

U.S. PATENT DOCUMENTS

| | | | | |
|---|---|---|---|---|
| 6,082,633 | A | 7/2000 | Kephart et al. | |
| 6,123,229 | A * | 9/2000 | Barish | 222/79 |
| 6,158,619 | A | 12/2000 | D'Andrade et al. | |
| 6,167,925 | B1 * | 1/2001 | D'Andrade | 222/79 |
| 6,250,565 | B1 | 6/2001 | Ogie et al. | |
| 6,364,162 | B1 | 4/2002 | Johnson et al. | |
| 6,592,055 | B1 | 7/2003 | Marino | |
| 6,631,830 | B2 * | 10/2003 | Ma et al. | 222/79 |
| 6,691,739 | B2 | 2/2004 | Rosenberg | |
| 6,892,902 | B2 * | 5/2005 | Hornsby et al. | 222/79 |
| 6,929,151 | B1 * | 8/2005 | Clayton | 222/79 |
| 6,935,531 | B1 * | 8/2005 | Clayton | 222/79 |
| 7,185,787 | B2 * | 3/2007 | Brown et al. | 222/79 |
| 7,458,485 | B2 * | 12/2008 | Amron | 222/79 |
| 2005/0173452 | A1 | 8/2005 | Brown et al. | |
| 2005/0211805 | A1 * | 9/2005 | Eddins et al. | 239/589 |

* cited by examiner

TOY WATER GUN WITH SELECTABLE PULSE AND STREAM DISCHARGE NOZZLES

BACKGROUND OF THE INVENTION

The present invention relates generally to a toy water gun and, more particularly, to a pressurized toy water gun having expandable bladders for achieving a constant pressure water discharge and selectable nozzles for discharging either a continuous stream or several short pulsating bursts of liquid.

Pressurized squirt guns that eject water and other liquids and other toys for discharging liquids from a pressurized reservoir are generally known in the art. For example, U.S. Pat. No. 6,929,151 to Clayton discloses a water squirting toy including a freestanding base upon which a water gun is supported. The toy includes a garden hose connector to facilitate connection of the toy to a household water supply. The gun can be operated to discharge water directly from the household supply while supported on the base. The toy may be provided with couplers for releasably joining the gun to the base, and the gun may include a water storage reservoir so that the gun can be separated from the base and independently operated to discharge water. The gun may also include an expandable bladder in fluid communication with the garden hose connector to receive and store water prior to pulling the trigger to discharge the stored water.

U.S. Pat. No. 5,799,827 to D'Andrade discloses an expandable bladder toy water gun. The toy water gun includes a main housing having a barrel and water ejection nozzle, a handle and a trigger, as well as an inflatable bladder connected to the main housing, with the bladder having an inlet and an outlet. The toy water gun also includes a storage tank for supplying water thereto, as well as a hand pump connected to both the storage tank and the bladder. The pump is physically connected to the housing and functionally connected to the storage tank and the bladder inlet. A bladder release valve having an upstream side and a downstream side is connected to the bladder outlet at the valve's upstream side, is connected to the trigger for opening and closing thereof, and is connected to the nozzle at the valve's downstream side for subsequent water ejection when the trigger is pulled.

U.S. Pat. No. 5,366,108 to Darling discloses a toy water gun that can release a directed stream of water from a pressurized receptacle. The toy water gun is connected to the pressurized receptacle by a flexible hose and a pull on the trigger releases a directed stream of water. In one embodiment, the receptacle has a one way valve attached thereto that allows pressurized water to only enter the receptacle. A flexible tube is attached to the one-way valve on one end with the flexible tubing terminating with a hose fitting on the other end attachable to a hose bib. The pressurized water is supplied by a water system such as a municipal water supply. Another embodiment uses a bladder inside a receptacle containing trapped air that is connected directly by flexible tubing to a shut off valve which is further connected by flexible tubing to a hose bib that supplies pressurized water. When the receptacle is fully charged and the pressure in the receptacle is equal to the pressure of the municipal water supply, the shut off valve is turned off and the flexible tubing to the hose bib is disconnected at the shut off valve. A flexible tube is then connected from the shut off valve to the toy water gun. The shut off valve is then turned on and the toy water gun is ready for use.

Sprinkler toys discharging bursts of liquid are also known in the art. U.S. Patent Publ. No. 2005-0211805 to Eddins et al. discloses a sprinkler toy and a method for producing a geyser-like burst of liquid supplied by a source of pressurized liquid. The sprinkler toy may include a reservoir in fluid communication with the pressurized liquid source, wherein the volume of the reservoir may increase as the liquid is supplied to the reservoir by the pressurized liquid source, and wherein the pressure within the reservoir may increase as the amount of liquid within the reservoir and the volume of the reservoir increase. The sprinkler toy may further include a valve in fluid communication with the reservoir and operatively coupled to the reservoir, wherein the valve may be moveable between a closed position and an open position, wherein the increase of the volume of the reservoir from a first volume to a second volume may cause the valve to move from the closed position to the open position, and wherein the pressure within the reservoir when the valve moves to the open position may cause a geyser-like burst of liquid stored in the reservoir to discharge through the valve. In alternate embodiments, the sprinkler toy may further include nozzles in fluid communication with the pressurized water source and providing a constant discharge of liquid, and a housing having moving components that move in response to the increase in volume of the reservoir.

SUMMARY OF THE INVENTION

In one aspect, the invention is directed to a toy gun for discharging pressurized liquid. The toy gun may include a pressurization mechanism providing a supply of pressurized liquid, a first elastomeric bladder in fluid communication with the pressurization mechanism and receiving pressurized liquid from the pressurization mechanism, wherein the first bladder expands and the pressure within the first bladder increases as the pressurized liquid is received by the first bladder. The toy gun may further include a first valve having an inlet in fluid communication with the first bladder and being moveable between a closed position and an open position, a second elastomeric bladder in fluid communication with an outlet of the first valve, and a second valve having an inlet in fluid communication with the second bladder and being moveable between a closed position and an open position. The second valve may be operatively coupled to the second bladder such that expansion of the second bladder causes the second valve to move from the closed position to the open position. When the first bladder is filled with pressurized liquid and the first valve is moved to the open position, pressurized liquid from the first bladder may be forced into the second bladder, the second bladder may expand as the pressurized liquid from the first bladder is received, and the expansion of the second bladder may cause the second valve to move to the open position such that the pressure within the second bladder causes a burst of liquid stored in the second bladder to discharge through the second valve.

In another aspect, the invention is directed to a toy gun for discharging pressurized liquid that may include a pressurization mechanism providing a supply of pressurized liquid, and an elastomeric supply bladder in fluid communication with the pressurization mechanism and receiving pressurized liquid from the pressurization mechanism, wherein the supply bladder expands and the pressure within the supply bladder increases as the pressurized liquid is received by the supply bladder. The toy gun may further include a trigger valve having an inlet in fluid communication with the supply bladder and being moveable between a closed position and an open position, and a mode selection valve having an inlet in fluid communication with the outlet of the trigger valve, a first outlet and a second outlet. The mode selection valve may have a stream position placing the inlet of the mode selection valve in fluid communication with the first outlet and a pulse position placing the inlet of the mode selection valve in fluid communication with the second outlet. The toy gun may also include an elastomeric pulse bladder in fluid communication with the second outlet of the mode selection valve, and a pulse valve having an inlet in fluid communication with the pulse bladder and an outlet, wherein the pulse valve is moveable between a closed position and an open position, and the pulse valve is operatively coupled to the pulse bladder such that expansion of the pulse bladder causes the pulse valve to move from the closed position to the open position. When the supply bladder is filled with pressurized liquid, the trigger valve is moved to the open position and the mode selection valve is in the stream position, pressurized liquid from the supply bladder is forced through the second outlet of the mode selection valve to discharge a continuous stream of liquid. Further, when the supply bladder is filled with pressurized liquid, the trigger valve is moved to the open position and the mode selection valve is in the pulse position, pressurized liquid from the supply bladder is forced into the pulse bladder, the pulse bladder expands as the pressurized liquid from the supply bladder is received, and the expansion of the pulse bladder causes the pulse valve to move to the open position such that the pressure within the pulse bladder causes a burst of liquid stored in the pulse bladder to discharge through the pulse valve.

In a further aspect, the invention is directed to a toy gun for discharging pressurized liquid that may have an inlet port having a coupling configured to connect to an external source of pressurized liquid to the toy gun, a trigger valve having an inlet in fluid communication with the inlet port and being moveable between a closed position and an open position, an elastomeric pulse bladder in fluid communication with an outlet of the trigger valve, and a pulse valve having an inlet in fluid communication with the pulse bladder and being moveable between a closed position and an open position, The pulse valve may be operatively coupled to the pulse bladder such that expansion of the pulse bladder causes the pulse valve to move from the closed position to the open position. When an external source is connected to the coupling and providing pressurized liquid and the trigger valve is moved to the open position, pressurized liquid from the external source is forced into the pulse bladder, the pulse bladder expands as the pressurized liquid from the external source is received, and the expansion of the pulse bladder causes the pulse valve to move to the open position such that the pressure within the pulse bladder causes a burst of liquid stored in the pulse bladder to discharge through the pulse valve.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
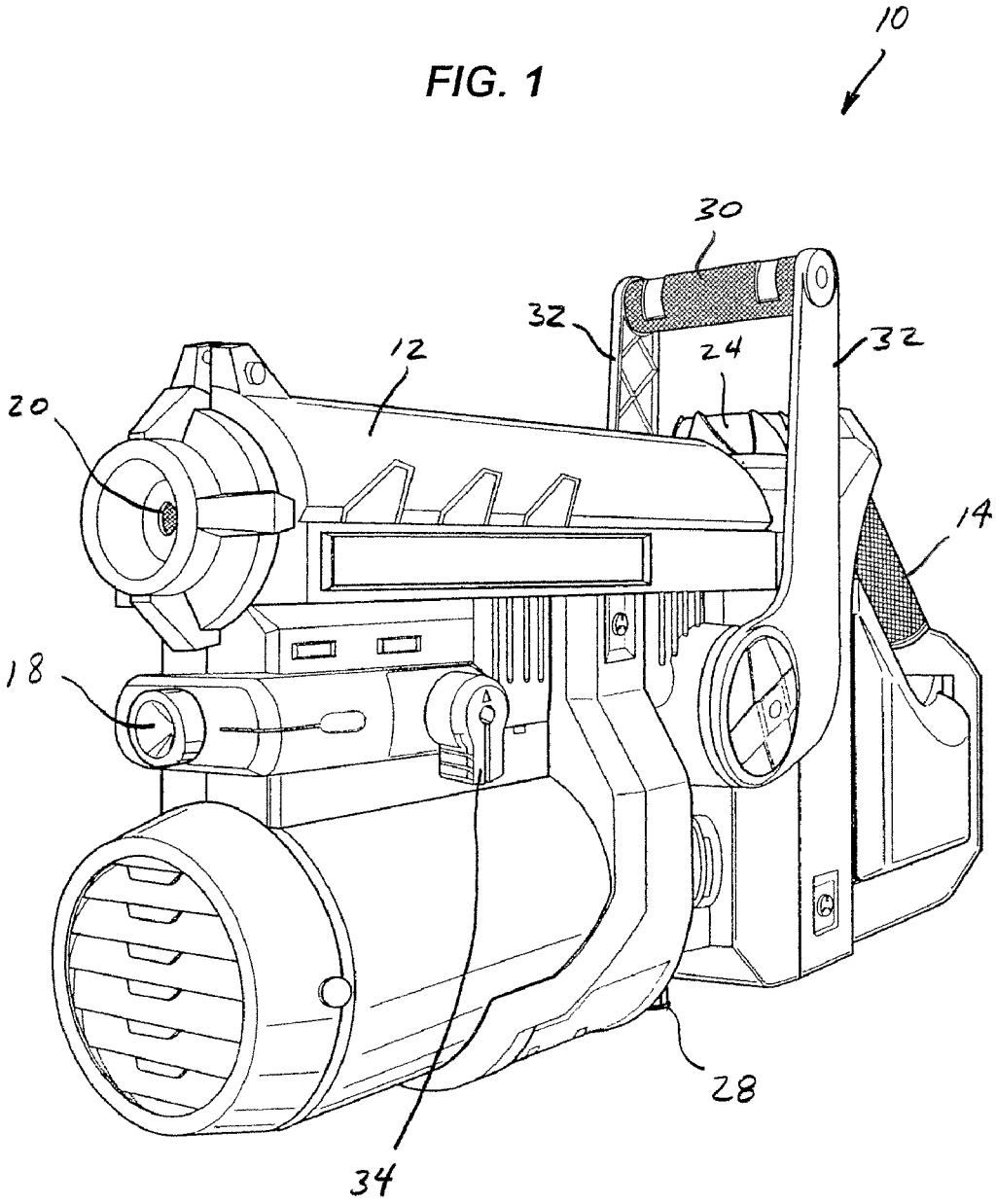
FIG. 1 is a perspective view of a toy water gun having an upper pulse nozzle and a lower stream nozzle in accordance with the invention.
Figure 2:
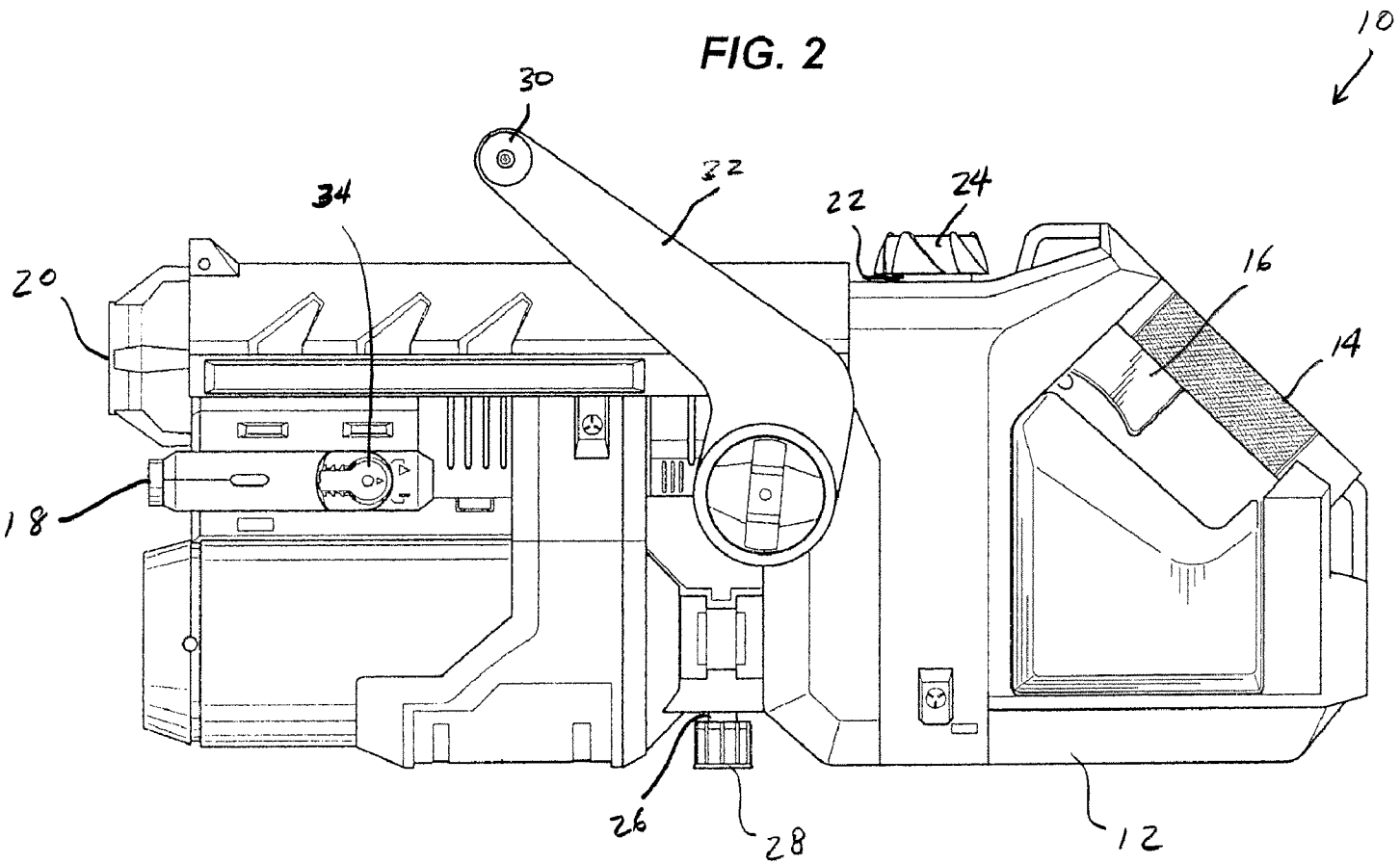
FIG. 2 is a side view of the toy water gun of FIG. 1.
Figure 3:
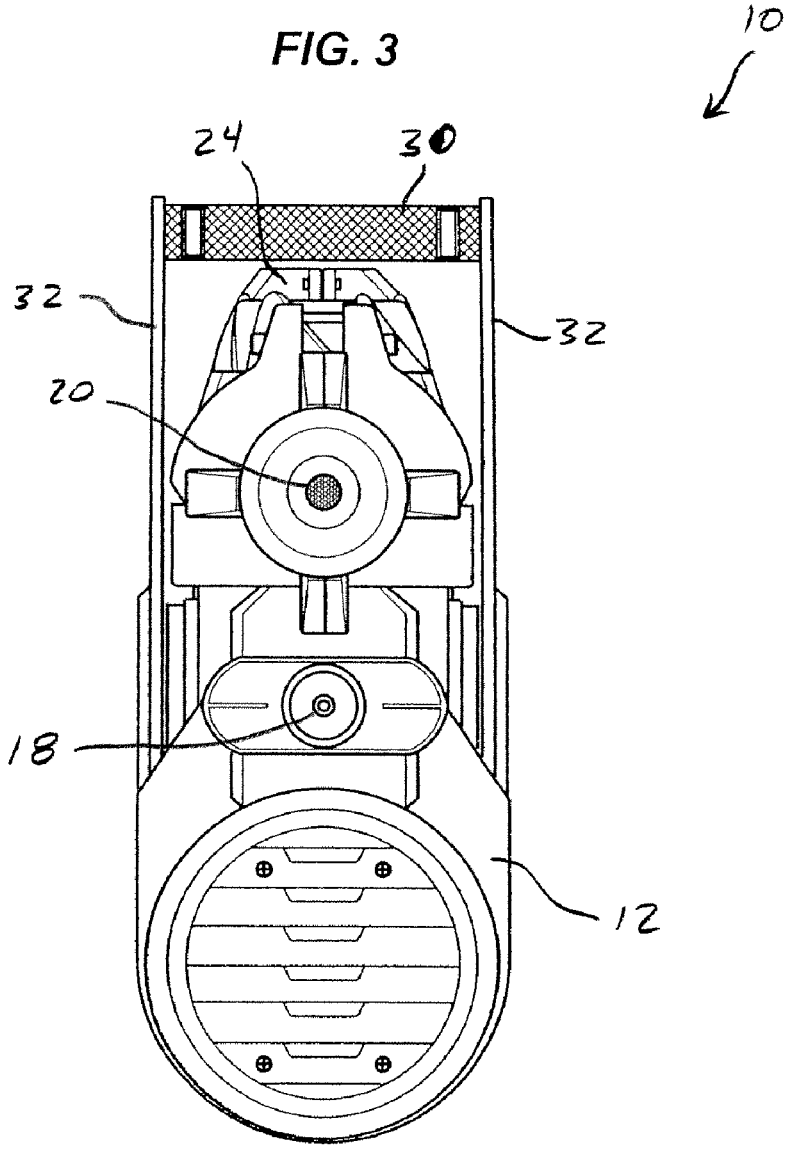
FIG. 3 is a front view of the toy water gun of FIG. 1.

FIGS. 1-3 illustrate perspective, side and front views, respectively, of an embodiment of a pressurized toy gun 10 in accordance with the present invention. The toy gun 10 includes an outer housing 12 providing support for the components of the toy gun 10 and having a grip 14 configured to be grasped by a user with either hand and to position the user's index finger proximate a moveable trigger 16 that may be moved rearward to cause the toy gun 10 to discharge a pressurized liquid. The toy gun 10 alternately discharges a continuous stream of liquid from a lower stream nozzle 18 and several short pulsating burst of liquid from an upper pulse nozzle 20. The toy gun 10 may be provided with multiple inlets for providing liquid to be discharged from the toy gun 10. An upper inlet 22 may be located on the top of the housing 12 and may be threaded so that a fill cap 24 may be disposed thereon to seal a non-pressurized reservoir of the toy gun 10. The fill cap 24 may be removed to add liquid, or may be configured with a one-way valve allowing liquid to be poured or discharged into the reservoir while preventing liquid from leaking out. An example of such a fill cap 24 is illustrated in U.S. Patent Pub. No. 2004-0261902 to Eddins et al., entitled "Quick Fill Cap for a Toy Water Gun," which is expressly incorporated by reference herein.

A second lower inlet 26 may be disposed on the bottom of the housing 12 and may include a coupler 28 for connecting a garden hose or other pressurized liquid source. The coupler 28 may be any appropriate coupling for connecting the liquid source to the lower inlet 26, such as a standard female threaded garden hose coupler, a quick-connect coupling and the like. When liquid is added via the lower inlet 26, the toy gun 10 will be pressurized and ready to discharge fluid from one of the nozzles 18, 20. Conversely, liquid added at the upper inlet 22 is not pressurized, and the toy gun 10 is prepared for discharge by the user manipulating a pump handle 30 connected via pump arms 32 to a pump within the housing 12 in a manner described more fully below. To allow selection between the nozzles 18, 20, the toy gun 10 further includes a mode selection knob 34 connected to a mode selection valve within the housing 12 that moves between a stream discharge position and a pulse discharge position as discussed further below.

Figure 4:
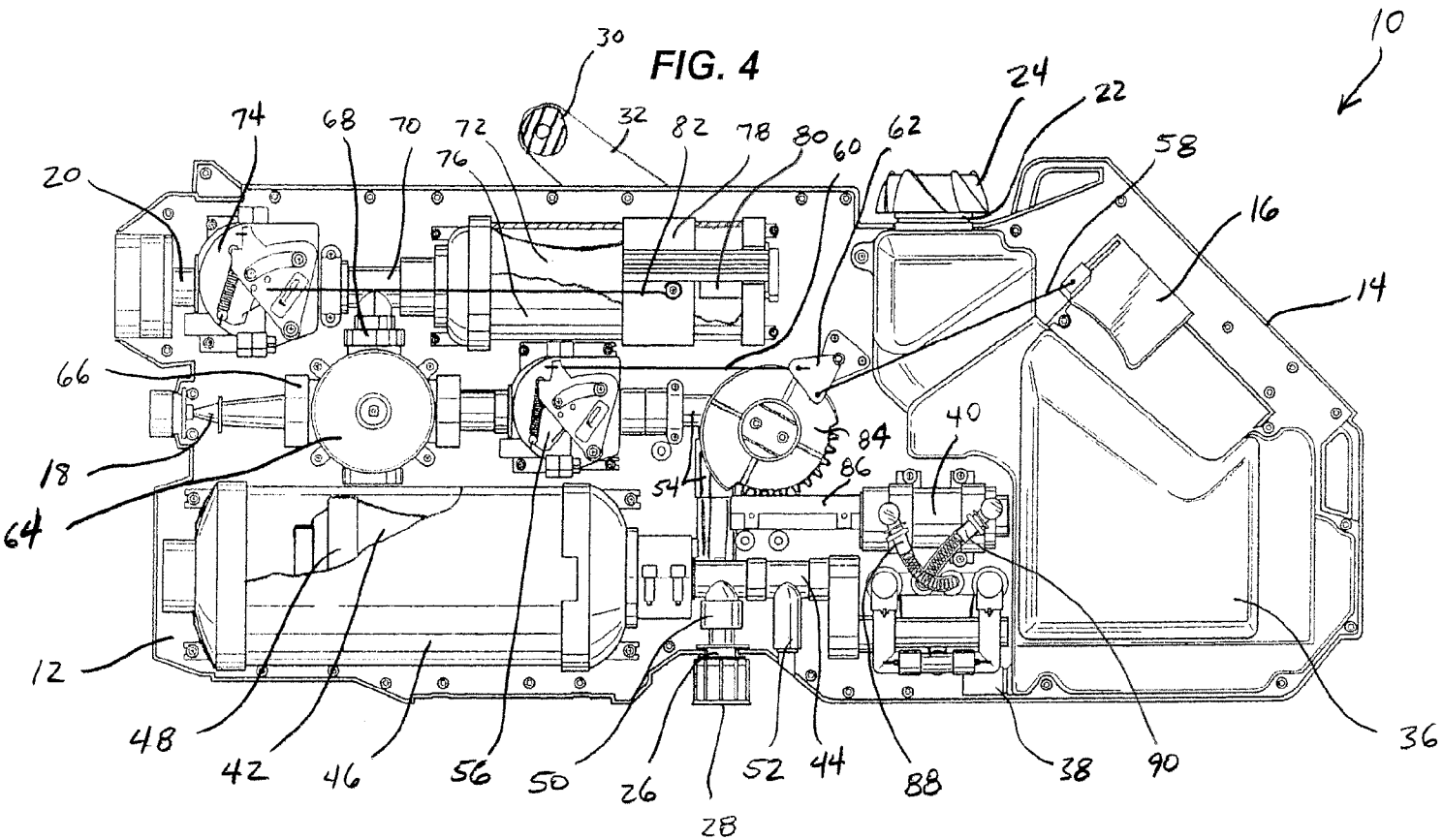
FIG. 4 is a side view of the toy water gun of FIG. 1 with one side of the housing removed to expose the internal components.

FIG. 4 illustrates the toy gun 10 with the facing side of the housing 12 removed to reveal the interior components of the toy gun 10. The upper inlet 22 is an inlet port for a non-pressurized reservoir 36. The reservoir 36 includes an outlet port 38 in fluid communication with an upstream side of a dual-action pump 40. The dual-action pump 40 draws non-pressurized liquid from the reservoir 36 via the outlet port 38 and pumps the drawn liquid under pressure through a downstream side of the pump 40 to a large supply bladder 42 in fluid communication therewith via a conduit 44. The operation of the dual-action pump 40 is described more fully below. As an alternative to the liquid from the reservoir 36, the lower inlet 26 is connected to the conduit 44 downstream of the pump 40 to allow liquid from a pressurized source to be pumped into the supply bladder 42. A connector 50 between the lower inlet 26 and conduit 44 includes a check valve to prevent liquid from flowing back out of the inlet 26.

The supply bladder 42 may be fabricated from a resilient material, such as rubber, and is disposed within a supply bladder housing 46. The housing 46 allows the supply bladder 42 to expand as the bladder 42 fills with liquid, but limits the expansion and, consequently, the volume of liquid in the bladder 42. An end cap 48 may be attached to an end of the bladder 42 and slidable within the housing 46 to limit the expansion of the bladder 42. In addition to limiting the volume of the bladder 42, the pressure within the bladder 42 is limited by a safety valve 52 connected to the conduit 44 and configured to open and vent to the atmosphere when a predetermined maximum pressure is exceeded. If desired, the safety valve 52 may be adjustable via a set screw or other mechanism to regulate the maximum pressure.

The supply bladder 42 is operatively connected to the discharge mechanisms of the toy gun 10 by a conduit 54 placing the supply bladder 42 in fluid communication with an inlet of a trigger snap-action ball valve 56. The trigger ball valve 56 is normally disposed in a closed position to prevent the discharge of liquid until the trigger 16 is pulled rearward by the user. The trigger ball valve 56 is operatively connected to the trigger 16 by links 58, 60 and a rocker 62 so that the trigger ball valve 56 is tripped when the trigger 16 is pulled as will be described more fully below. The outlet of the trigger ball valve 56 is connected to an inlet of a three-way mode selection valve 64 that is coupled to and operated by the mode selection knob 34 on the exterior of the housing 12. The mode selection valve 64 includes a first outlet 66 connected to the stream nozzle 18, and a second outlet 68 connected to a discharge mechanism for the pulse nozzle 20. The second outlet 68 leads to a T-connector 70 having one branch connecting the second outlet 68 to a pulse bladder 72 and the other branch connected to a pulse nozzle snap-action ball valve 74. As with the supply bladder 42, the pulse bladder 72 is fabricated from an elastomeric material, and is disposed within a pulse bladder housing 76. A slidable carriage 78 is disposed on the exterior of the pulse bladder housing 76 and includes a shoulder 80 extending inwardly through the rear wall of the pulse bladder housing 76 and into the interior of the housing 76. As discussed more fully below, the pulse bladder 72 engages shoulder 80 to slide the carriage 78 rearward on the pulse bladder housing 76 and trip the pulse nozzle ball valve 74 via the connection of a link 82 to discharge a pulse of liquid through the pulse nozzle 20.

Figure 5:
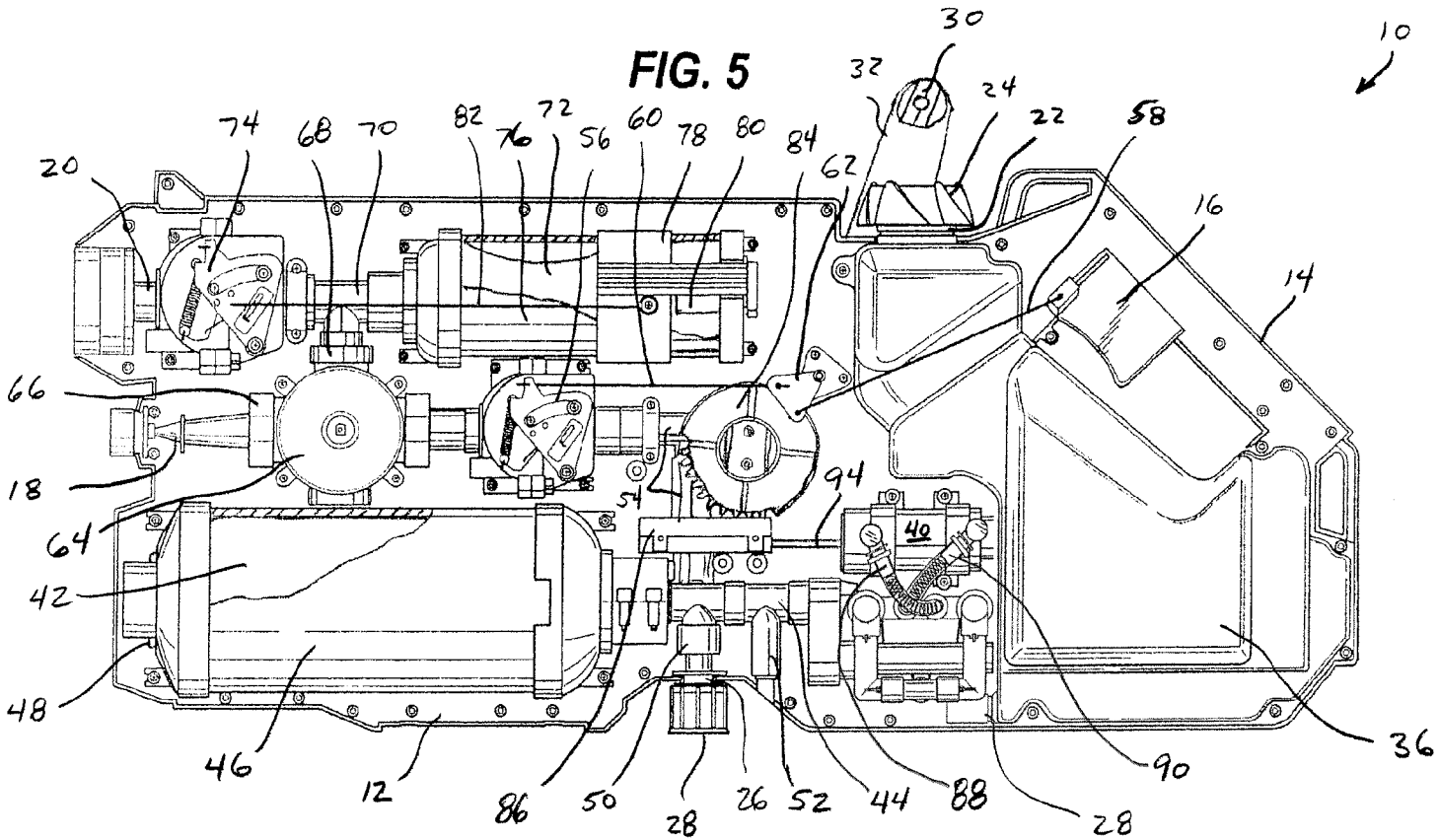
FIG. 5 is a side view of the toy water gun of FIG. 1 with the pump are pulled rearward and the large bladder filled with pressurized liquid.
Figure 6:
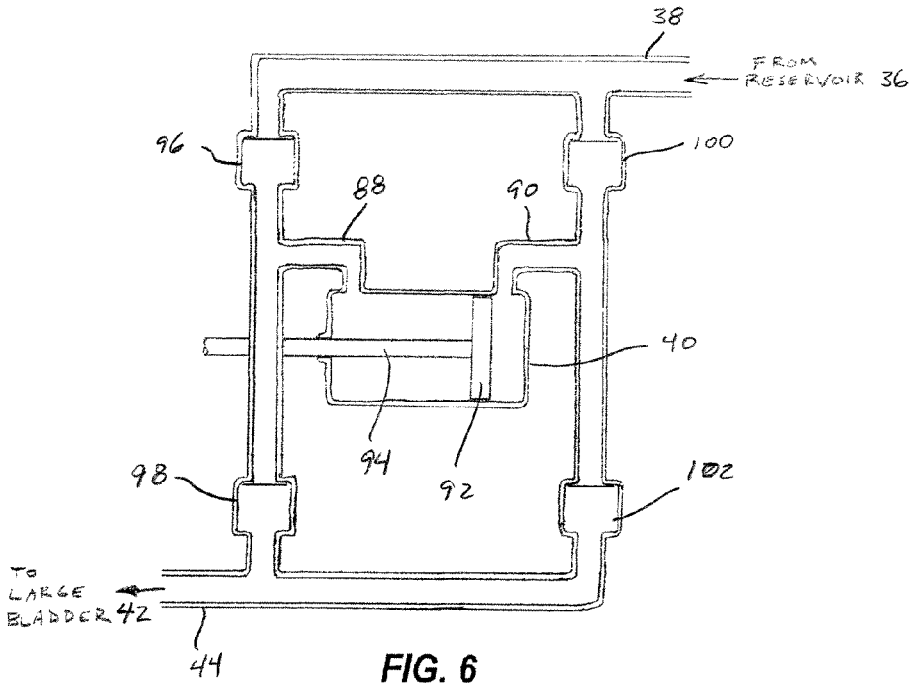
FIG. 6 is a schematic illustration of a dual-action pump and check valves that may be used in the toy water gun of FIG. 1 with the pump in a stationary position.

As discussed above, the dual-action pump 40 pumps liquid from the non-pressurized reservoir 36 to the supply bladder 42. The dual-action pump 40 is actuated when the user moves the piston handle 30 back and forth. The piston arms 32 are connected to a pump gear 84 having teeth meshing with a pump rack 86 to drive a piston within the dual-action pump 40. As the handle 30 is cycled, liquid from the reservoir 36 is pumped into the conduit 44 and supply bladder 42 alternately through a forward conduit 88 as the pump handle 30 moves from the position shown in FIG. 4 to the position shown in FIG. 5, and through a rearward conduit 90 as the handle 30 moves forward. The configuration and operation of the dual-action pump 40 are illustrated schematically in FIGS. 6-8. Referring to FIG. 6, the dual-action pump 40 includes a piston 92 driven by a piston stem 94 that is connected to the pump rack 86. The forward and rearward conduits 88, 90, respectively, are connected to opposite ends of the dual-action pump 40 on either side of the piston 92. The opposite end of the forward conduit 88 is connected between a forward inlet check valve 96 and a forward outlet check valve 98, and the opposite end of the rearward conduit 90 is connected between a rearward inlet check valve 100 and a rearward outlet check valve 102. The inlet check valves 96, 100 are in fluid communication with the outlet port 38 of the reservoir 36, and the outlet check valves 98, 102 are in fluid communication with the conduit 44 leading to the large bladder 42, with the check valves 96, 98, 100, 102 allowing fluid flow only in the direction of the supply bladder 42.

Figure 7:
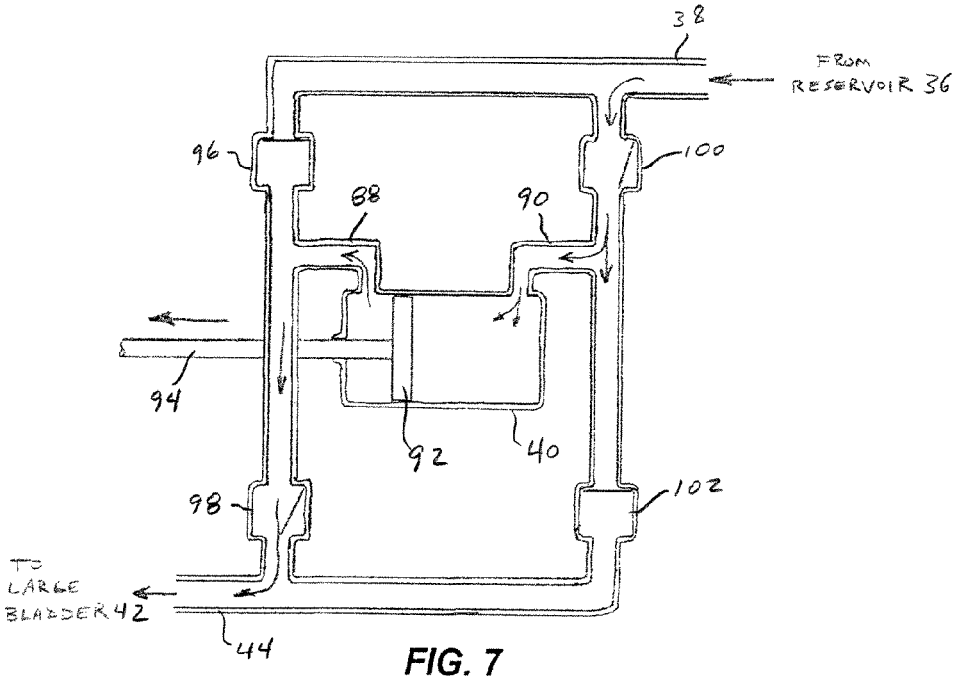
FIG. 7 is a schematic illustration similar to FIG. 6 and illustrating the piston moving through a forward stroke as the pump handle is pulled rearward.
Figure 8:
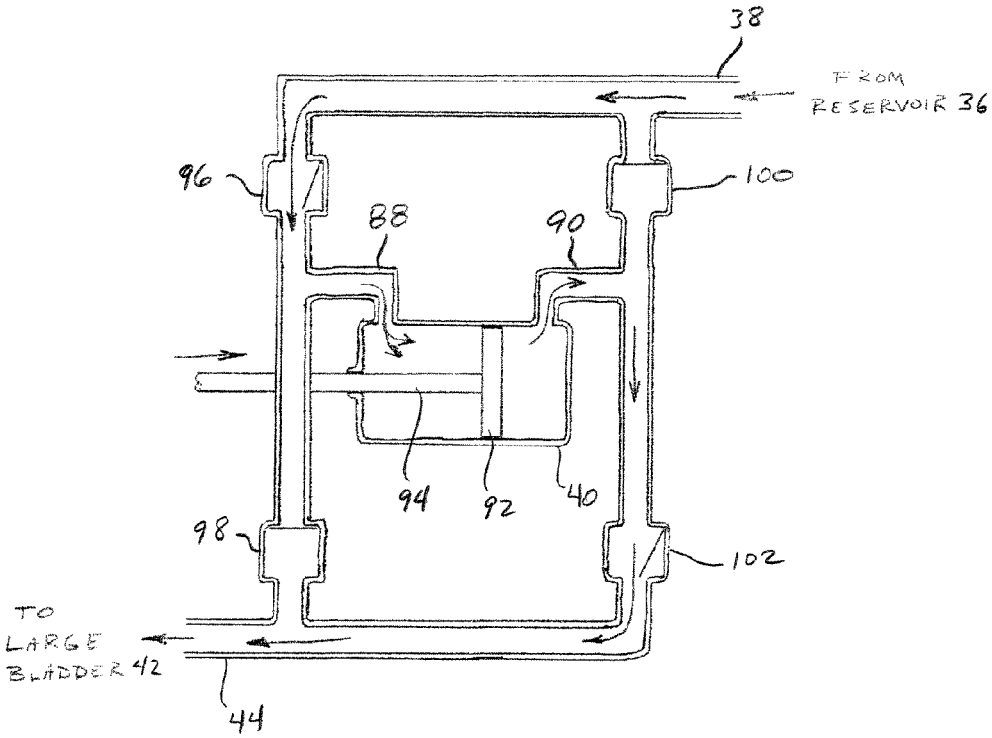
FIG. 8 is a schematic illustration similar to FIGS. 6 and 7 and illustrating the piston moving through a rearward stroke as the pump handle is pushed forward.

The illustrated configuration of the dual-action pump 40 and check valves 96, 98, 100, 102 facilitates pumping liquid from the reservoir 36 to the supply bladder 42 when the pump handle 30 moves in either direction. When the pump handle 30 is pulled rearward from the position shown in FIG. 4 to the position shown in FIG. 5, the pump gear 84 rotates clockwise to move the pump rack 86 toward the front of the toy gun 10 and pull the piston 92 and piston stem 94 forward as shown in FIG. 7. As the piston 92 moves toward the forward conduit 88, liquid to the left of the piston 92 is forced through the conduit 88 and forward outlet control valve 98 to the supply bladder 42. At the same time, the increased volume and corresponding pressure drop to the right of the piston 92 in the dual-action pump 40 causes liquid to be drawn from the reservoir 36 through the rearward inlet check valve 100 and conduit 90 and into the rearward portion of the dual-action pump 40. When the pump handle 30 is pushed forward, the pump gear 84 rotates counter-clockwise to move the pump rack 86 toward the dual-action pump 40 and push the piston 92 and piston stem 94 forward as shown in FIG. 8. As the piston 92 moves toward the rearward conduit 90, liquid to the right of the piston 92 is forced through the conduit 90 and rearward outlet control valve 102 to the supply bladder 42. At the same time, the increased volume and corresponding pressure drop to the left of the piston 92 in the dual-action pump 40 causes liquid to be drawn from the reservoir 36 through the forward inlet check valve 96 and conduit 88 and into the forward portion of the dual-action pump 40. As liquid is pumped either from the reservoir 36 via the dual-action pump 40 or by a pressurized source coupled to the toy gun 10 are the coupling 28, the supply bladder 42 expands within the bladder housing 46 as shown in FIG. 5 with the end cap 48 sliding forward. Once the supply bladder 42 expands to fill the bladder housing 46, attempting to pump additional liquid into the supply bladder 42 will cause the safety valve 52 to open and vent to the atmosphere.

Figure 9:
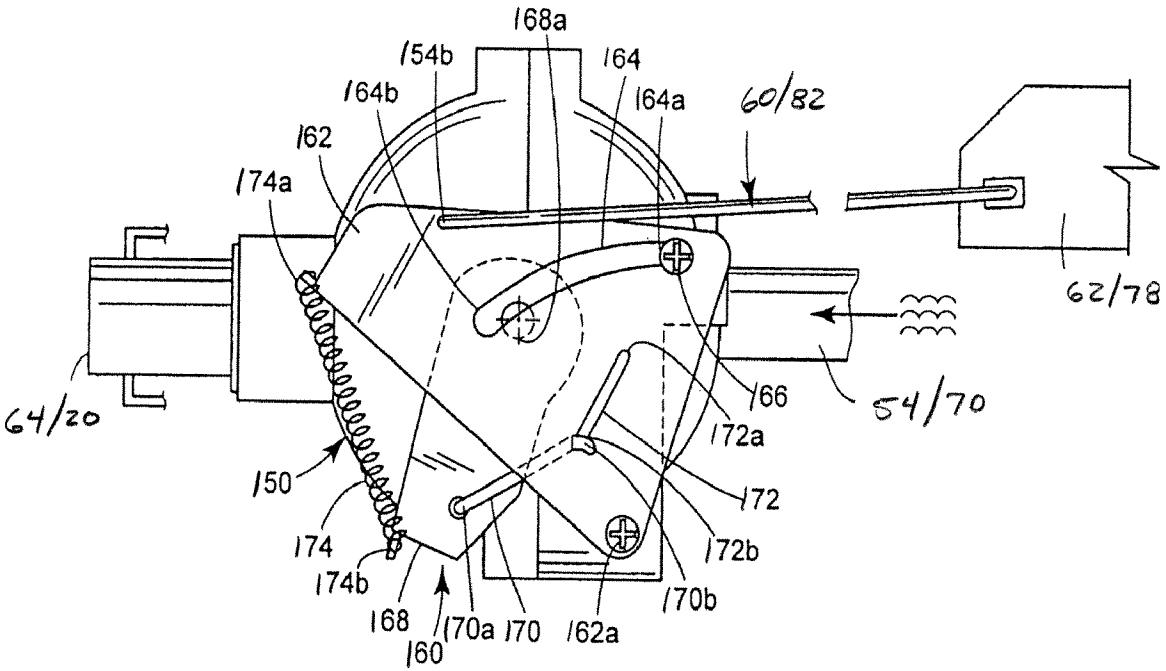
FIG. 9 is an enlarged fragmentary plan view of a snap action ball valve and trip assembly illustrated in a first position.
Figure 10:
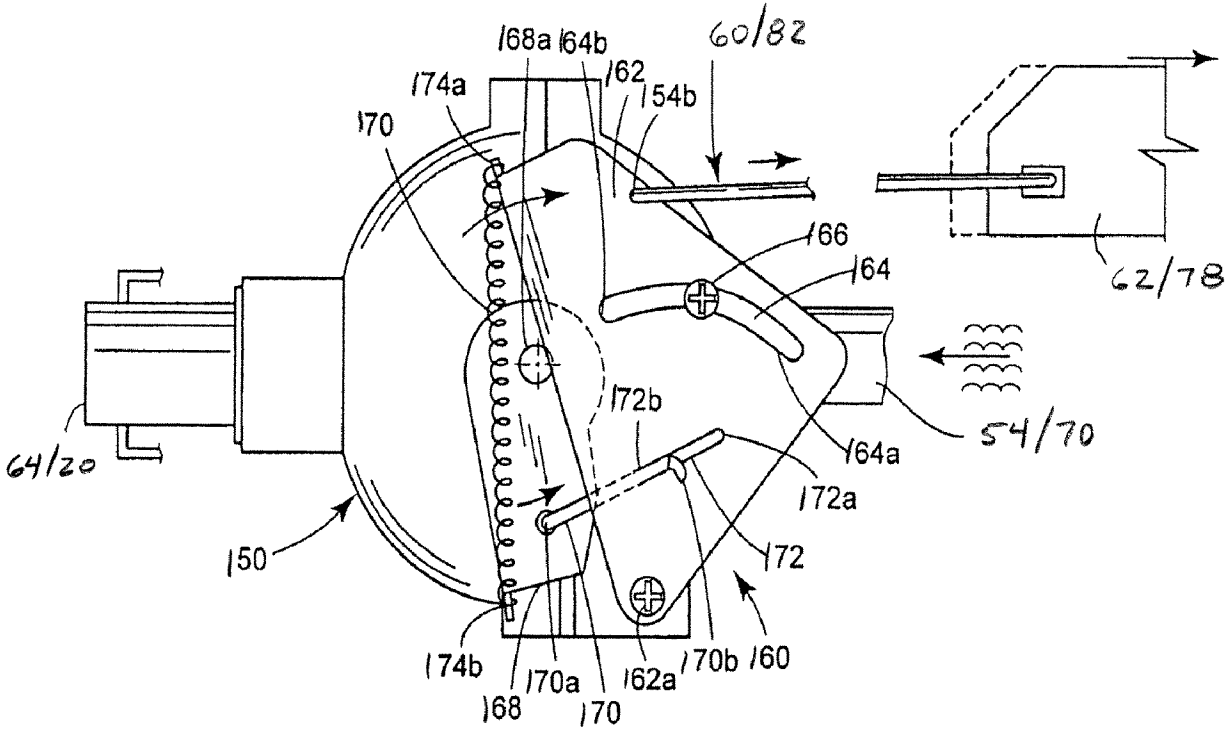
FIG. 10 is an enlarged fragmentary plan view similar to FIG. 9 and illustrating the trip assembly in a second position.
Figure 11:
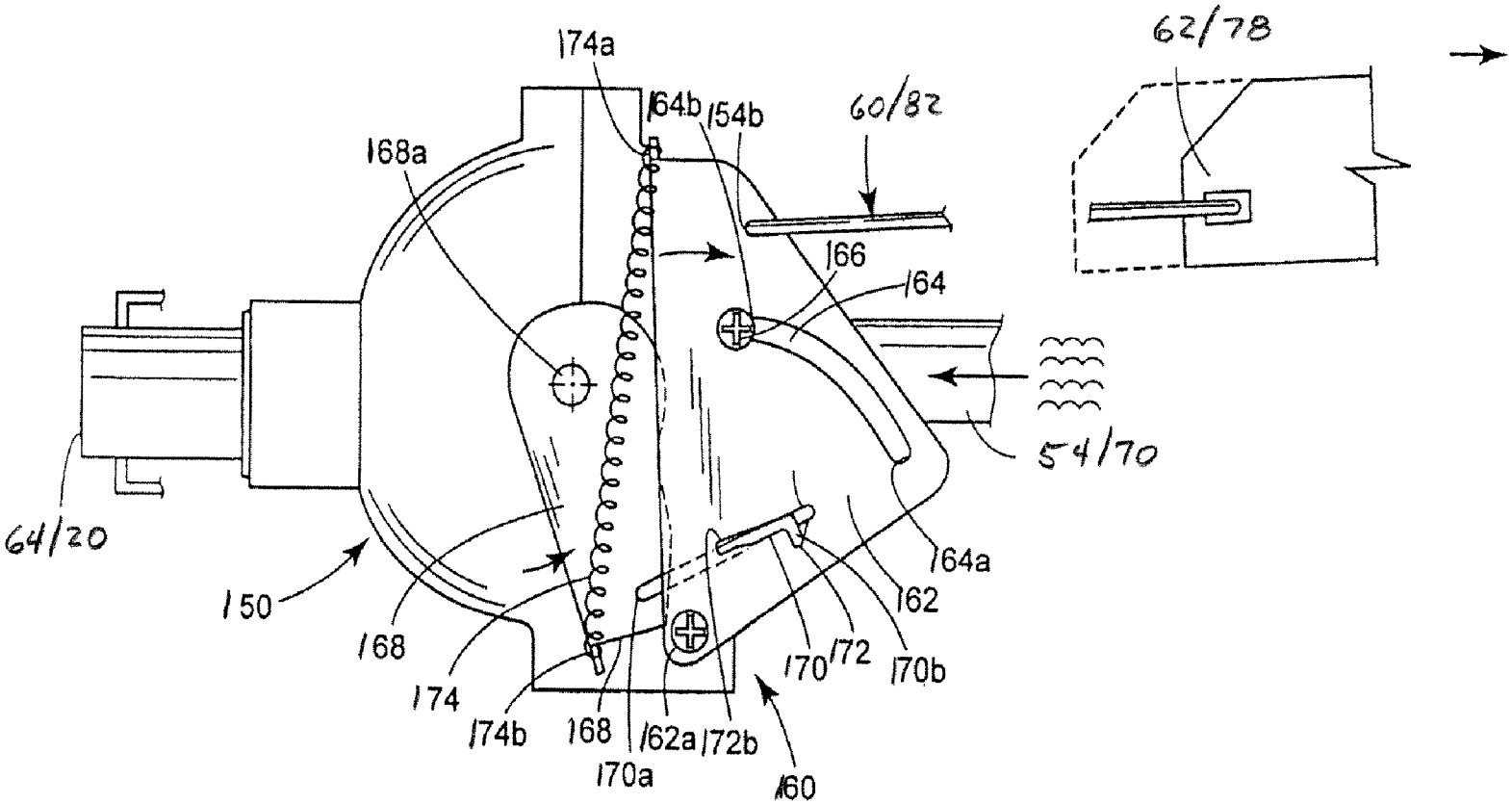
FIG. 11 is an enlarged fragmentary plan view similar to FIGS. 9 and 10 and illustrating the trip assembly in a third position.

FIGS. 9-11 illustrate one embodiment of a ball valve 150 and a corresponding snap action trip assembly 160 that may be used for the ball valves 56, 74 in the toy gun 10, with the trip assembly 160 being operatively connected to the rocker 62 or carriage 78 via the links 60, 82, respectively. The trip assembly 160 controls the actuation of the ball valve 150 and enables the water to be discharged to the mode selection valve 64 or the pulse nozzle 20 when the ball valve 150 snaps to the open position. The trip assembly 160 includes a pivot plate 162 which pivots about a pivot point 162*a*. The end of the link 60 or 82 is attached to the pivot plate 162. The pivot plate 162 includes a slot 164 having a pair of ends 164*a* and 164*b*, and a stop screw 166 is mounted so as to extend through the slot 164 and remain stationary relative to the housing of the ball valve 150. A lever 168 is operatively connected to the ball disposed within the ball valve 150, and the lever 168 is pivotable about a pivot point 168*a*. The lever 168 may be connected to the pivot plate 162 by a link arm 170 which fits within a slot 172 in the pivot plate 162. The slot 172 includes a pair of ends 172*a* and 172*b*. A spring 174 is connected to the pivot plate 162 at 174*a* and to the lever 168 at 174*b*. When the plate 162 and the lever 168 are positioned as shown in FIG. 9, the ball valve 150 is closed such that no water will flow through the ball valve 150.

Referring now to FIG. 10, when the rocker 62 or carriage 78 moves rearwardly from an initial position shown in FIG. 9 to an intermediate position of FIG. 10, the link 60 or 82 pulls on the pivot plate 162, causing the pivot plate 162 to shift in a generally clockwise direction about the pivot 162*a*. In the process, the link arm 170 pulls the lever, causing the lever 168 to rotate in a generally counterclockwise direction about the pivot point 168*a*, thus opening the ball valve 150 to allow liquid to flow through.

Referring now to FIG. 11, when the rocker 62 or carriage 78 is displaced sufficiently rearward to a position as shown in FIG. 11, the pivot plate 162 may pivot sufficiently far that the stop screw 166 comes into contact with the end 164*b* of the slot 164. Eventually, the spring 174 will pass the pivot point 168*a*, which causes the spring 174 to apply a further biasing force to the lever 168, thereby causing the lever 168 to rotate more rapidly in the counter-clockwise direction about the pivot point 168*a*. The link arm 170 may come into contact with the end 172*a* of the slot 172, thus limiting the rotational movement of the lever 168. The ball valve 150 may be arranged such that the ball valve 150 is fully opened when the lever 168 is rotated far enough.

Releasing the trigger 12, or disengagement of the shoulder 80 as liquid is discharged and the pulse bladder 72 contracts as describe more fully below, will permit the trip assembly 160 to return to the position of FIG. 9. Without the rearward force of the user pulling the trigger 12 or of the expanded pulse bladder 72, the force of the spring 174 may rotate the pivot plate 162 in the counterclockwise direction in FIG. 11. Once the direction of the force of the spring 174 moves past the pivot point 168*a* of the lever 168, the lever 168 rotates rapidly in the clockwise direction to snap the ball valve 150 shut. Once the ball valve 150 is shut and the trip assembly 160 is in the normal position, pressurized liquid may again be pumped into the supply bladder 42 or the pulse bladder 72 receive pressurized liquid from the supply bladder 42 in preparation for a subsequent discharge of liquid from the toy gun 10.

Consequently, in accordance with the disclosed example, the trip assembly 60 serves to define a first normal position shown in FIG. 9 (in which the ball valve 150 is closed), and a second open position shown in FIG. 11 (in which the ball valve 150 is in a fully open position), and to cause the ball valve 150 to move through intermediate positions (FIG. 10) therebetween. Other configurations may be chosen, including by way of example rather than limitation, a closed position and one or more open positions for the ball valve 150. Additional description of the snap action trip assembly 160 can be found in U.S. Pat. No. 6,631,830, entitled "Snap Action Ball Valve Assembly and Liquid Dispenser Using the Same," the entire disclosure of which is incorporated herein by reference.

Figure 12:
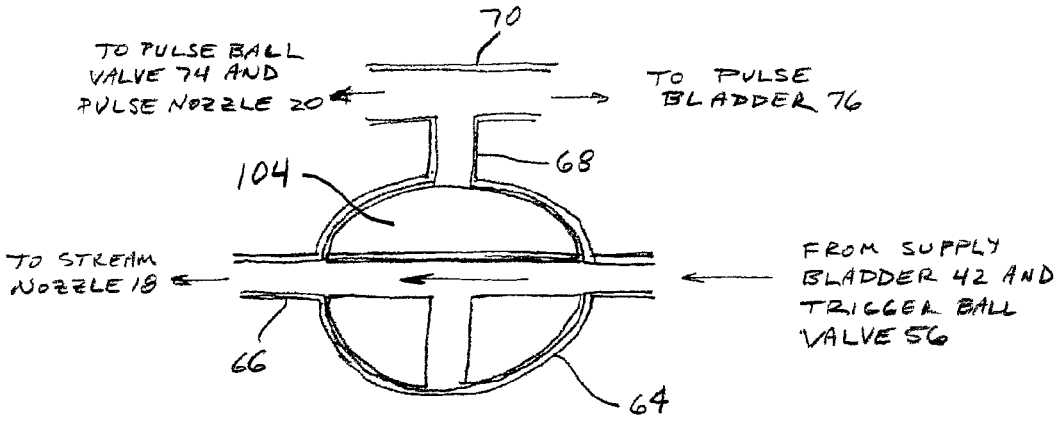
FIG. 12 is a schematic illustration of a three-way mode selection ball valve that may be used in the toy water gun of FIG. 1 illustrating the valve element in the stream mode position.
Figure 13:
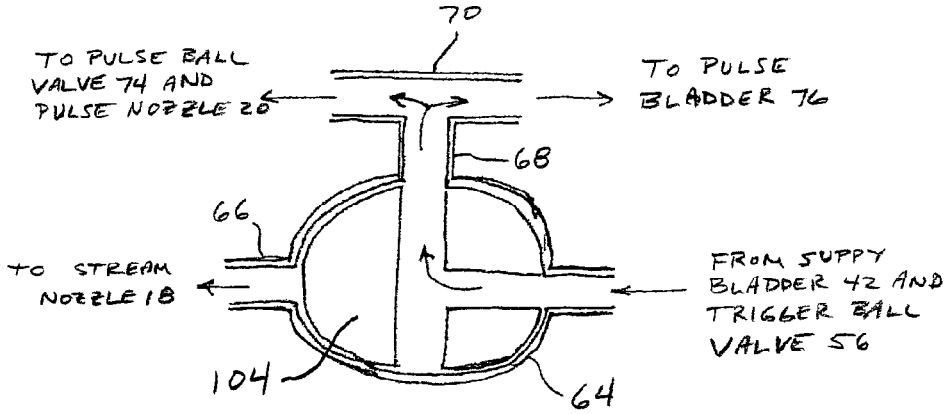
FIG. 13 is a schematic illustration similar to FIG. 12 and illustrating the valve element in the pulse mode position.

As discussed above, the user may select the discharge mode of the toy gun 10 between a stream of liquid discharged from the lower nozzle 18 and several short bursts of liquid from the upper nozzle 20. The user selects between the discharge modes by turning the mode selection knob 34 and, correspondingly, altering the flow path of the mode selection valve 64. FIGS. 12 and 13 schematically illustrate the operation of an embodiment of the mode selection valve 64. Referring to FIG. 12, the mode selection valve 64 may include a T-type valve element 104 or other appropriate valve element. The valve element 104 allows the mode selection valve 64 to receive fluid from the supply bladder 42 and trigger ball valve 56 and output the liquid at either the first outlet 66 to the stream nozzle 18 or the second outlet 68 to the pulse bladder 72 and pulse ball valve 74 via the connector 70. The valve element 104 includes a T-shaped channel and is rotatable to place the inlet of the valve 64 in fluid communication with either the first outlet 66 (FIG. 12) or the second outlet 68 (FIG. 13). Other configuration of three-way valves that may be implemented as the mode selection valve 64 will be apparent to those skilled in the art and are contemplated by the inventors as having use in toy guns in accordance with the present disclosure.

Figure 14:
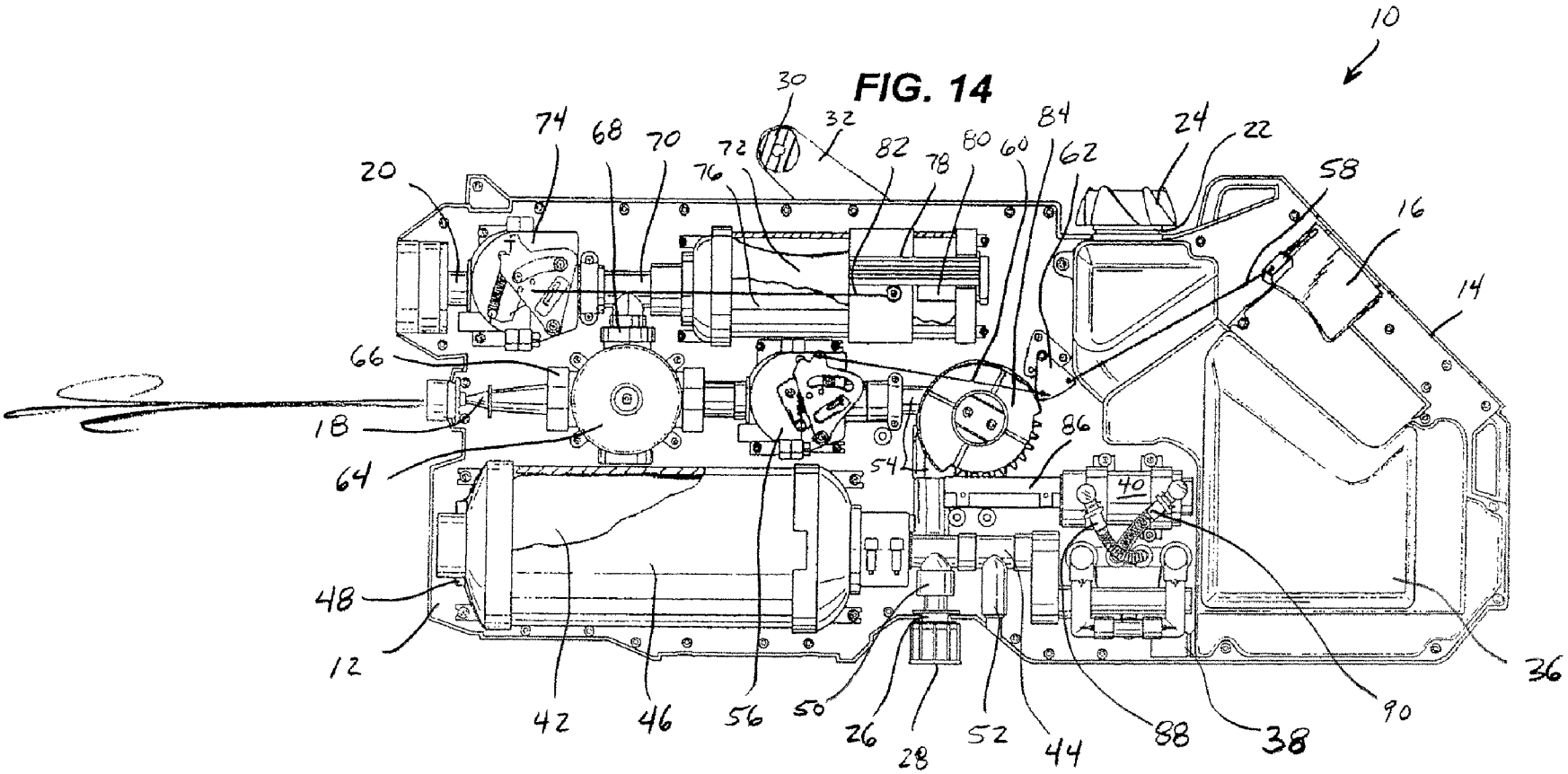
FIG. 14 is a side view of the toy water gun as illustrated in FIG. 4 with the trigger pulled and the three-way mode selection valve in the stream mode position.

Once the supply bladder 42 is filled, either with liquid pumped from the reservoir 36 by the dual-action pump 40, or with liquid supplied by a pressurized source connected at the connector 28, the toy gun 10 is ready to discharge liquid through either the stream nozzle 18 or the pulse nozzle 20. FIG. 14 illustrates the toy gun 10 discharging a stream of liquid from the lower stream nozzle 18. Prior to discharge, the user ensures that the mode selection valve 64 is opened to the first outlet 66 by turning the mode selection knob 34 to the appropriate position. Once the knob 34 and valve 64 are set, the user squeezes the trigger 16. As the trigger 16 moves rearward, the links 56, 58 and rocker 62 move to rotate the pivot plate of the trigger ball valve 56 rearward. Eventually, the trigger ball valve 56 snaps open as described above to place the supply bladder 42 in fluid communication with the mode selection valve 64. The pressure exerted by the walls of the elastomeric supply bladder 42 forces the liquid therein through the conduit 54, trigger ball valve 56 and mode selection valve 64 to the first outlet 66. The liquid is discharged through the lower nozzle 18 in a continuous stream as long as sufficient pressure is exerted on the liquid by the supply bladder 42. If a pressurized source is connected to the coupler 28, the stream of liquid will be discharged until the user releases the trigger 16. When the trigger 16 is released, the trip assembly of the trigger ball valve 56 resets the valve 56 to the closed position so that the supply bladder 42 may be refilled in preparation for a subsequent discharge of liquid.

Figure 15:
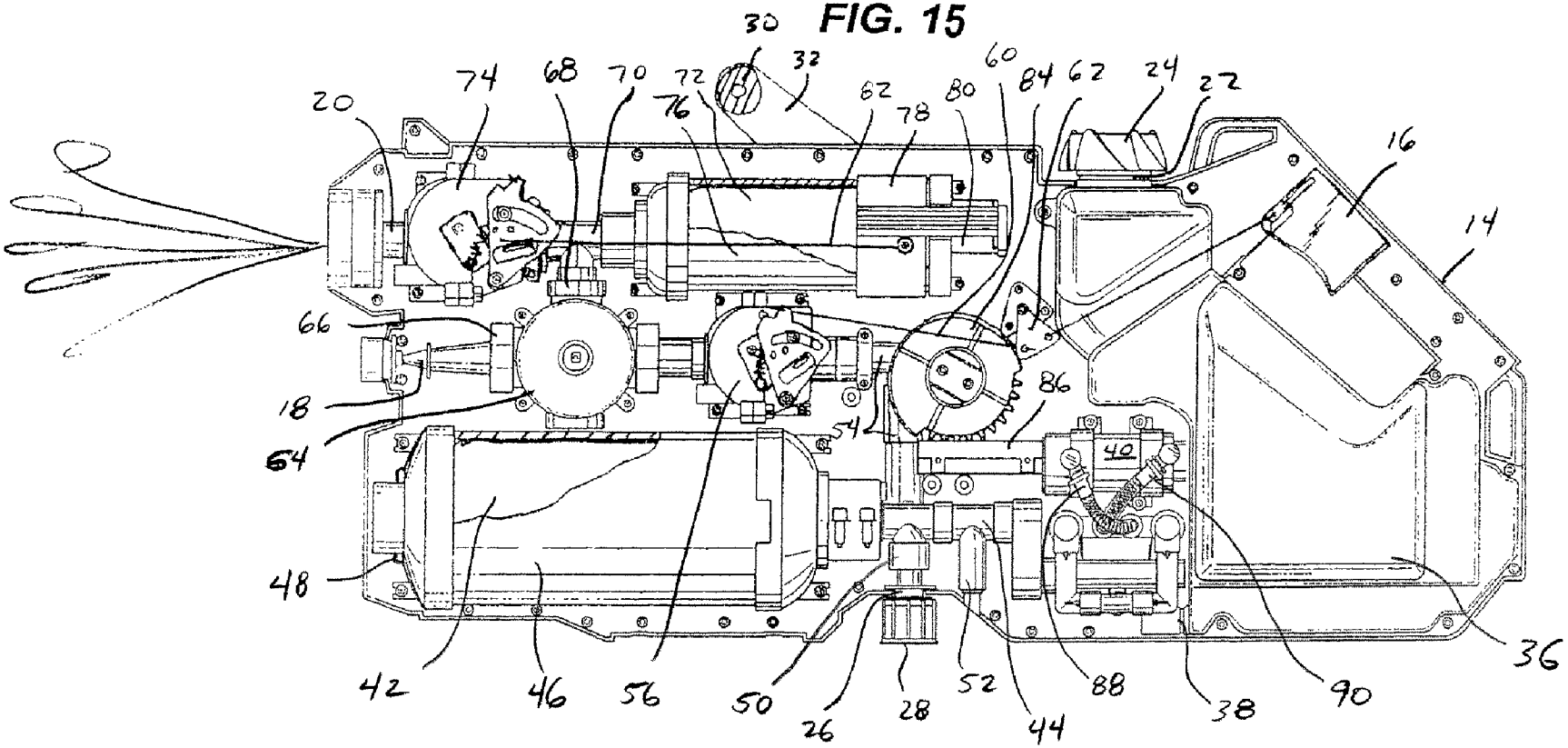
FIG. 15 is a side view of the toy water gun as illustrated in FIG. 4 with the trigger pulled and the three-way mode selection valve in the pulse mode position.

FIG. 15 illustrates the toy gun 10 discharging pulsating bursts of liquid from the upper nozzle 20. In the pulse mode, the mode selection knob 34 is turned to the pulse mode position to open the mode selection valve 64 to the second outlet 68. The user squeezes the trigger 16 to open the trigger ball valve 56 in the same manner as described above. When the trigger ball valve 56 snaps open, the pressurized liquid from the supply bladder 42 flows through the second outlet 68 of the mode selection valve 64, but is not immediately discharged from the pulse nozzle 20. The pulse ball valve 74 is disposed in the normal closed position until the pulse bladder 72 expands and forces the carriage 78 rearward. As the pulse bladder 72 fills and expands, the rearward end of the pulse bladder 72 engages the shoulder 80 and causes the carriage 78 to slide rearward on the pulse bladder housing 76. The movement of the carriage 78 is translated to the pivot plate of the pulse ball valve 74. Eventually, the pulse ball valve 74 snaps open as described above to place the pulse bladder 72 in fluid communication with the pulse nozzle 20. The pressure exerted by the walls of the elastomeric pulse bladder 72 forces the liquid therein through the ball valve 74 and pulse nozzle 20 to produce a burst of liquid. As the burst of liquid is discharged, the pulse bladder 72 contracts within the housing 76, thereby allowing the force of the spring of the pulse ball valve 74 to close the valve 74 and slide the carriage 78 forward on the pulse bladder housing 76 to reset the pulse discharge mechanism in preparation for discharging a subsequent burst of liquid.

Once the pulse ball valve 74 closes, the pulse bladder 72 begins to refill with liquid provided through the trigger ball valve 56. As long as the trigger 16 is pulled and the ball valve 56 remains open, the toy gun 10 will repeat the cycle described above and discharge a series of bursts of liquid from the pulse nozzle 20 as long as pressurized liquid is supplied to the pulse discharge mechanism. The bladders 42, 72 and bladder housings 46, 76, respectively, may be dimensioned so that multiple pulsating bursts of liquid may be discharged when the supply bladder 42 is filled to capacity and the user holds the trigger 16. For example, the supply bladder 42 and housing 46 may be configured to hold approximately 30 ounces of liquid, and the pulse bladder 72 and housing 76 may be configured to hold approximately 6.5 ounces of liquid. When the supply bladder 42 is filled to capacity, the toy gun 10 may discharge four bursts in succession with approximately 6.5 ounces of liquid in each burst. Alternatively, when a source of pressurized liquid is attached at the coupler 28, the toy gun 10 may be able to continuously discharge bursts of liquid as long as the trigger ball valve 56 remains open.

While one embodiment of the toy gun is illustrated and described herein, those skilled in the art will understand that other configurations of the toy gun 10 in accordance with the present disclosure are possible and are contemplated by the inventors. For example, the volume and elasticity of the bladders 42, 72, and the volumes of the housings 46, 76 may be varied to provide a desired number of continuous bursts and a desired volume of liquid to be discharged in each burst when liquid is discharged through the pulse nozzle 20. Moreover, the dual-action pump 40 may be replaced with other types of pumps or pressurization mechanisms capable of transferring liquid from the reservoir 36 to the supply bladder 42 and supplying pressure to fill the pulse bladder 42 to capacity. Additionally, the trigger ball valve 56 may be replaced with other types of valves that may be coupled to the trigger 16 so that the valve opens and closes when the trigger 16 is pulled and released, respectively. Still further, both the stream discharge mechanism and the pulse discharge mechanism may be implemented in toy guns offering only a single mode for discharging liquid. Other configurations and modifications to the toy gun 10 in accordance with the present disclosure and the components thereof will be apparent to those skilled in the art.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy gun for discharging pressurized liquid, comprising:

a pressurization mechanism providing a supply of pressurized liquid;

a first elastomeric bladder in fluid communication with the pressurization mechanism and receiving pressurized liquid from the pressurization mechanism, wherein the first bladder expands and the pressure within the first bladder increases as the pressurized liquid is received by the first bladder;

a first valve having an inlet in fluid communication with the first bladder and being moveable between a closed position and an open position;

a second elastomeric bladder in fluid communication with an outlet of the first valve; and a second valve having an inlet in fluid communication with the second bladder and being moveable between a closed position and an open position, the second valve being operatively coupled to the second bladder such that expansion of the second bladder causes the second valve to move from the closed position to the open position, and the second elastomeric bladder is not an integral component of the second valve, wherein, when the first bladder is filled with pressurized liquid and the first valve is moved to the open position, pressurized liquid from the first bladder is forced into the second bladder, the second bladder expands as the pressurized liquid from the first bladder is received, and the expansion of the second bladder causes the second valve to move to the open position such that the pressure within the second bladder causes a burst of liquid stored in the second bladder to discharge through the second valve.

2. A toy gun in accordance with claim 1, wherein the second valve moves from the open position to the closed position when the second bladder contracts due to the discharge of the burst of liquid.

3. A toy gun in accordance with claim 1, wherein the first bladder is dimensioned to receive a volume of liquid with sufficient pressure to cause multiple bursts of liquid from the second bladder and second valve without supplying additional pressurized liquid from the pressurization mechanism to the first bladder.

4. A toy gun in accordance with claim 3, wherein the toy gun discharges multiple bursts of liquid while the first valve remains open when the first bladder contains a sufficient volume of pressurized liquid.

5. A toy gun in accordance with claim 1, wherein the pressurization mechanism comprises an inlet having a coupling configured to connect to an external source of pressurized liquid and a check valve allowing flow of liquid only in the direction from the coupling to the first bladder.

6. A toy gun in accordance with claim 1, comprising a reservoir configured to receive a quantity of liquid, and wherein the pressurization mechanism comprises a pump in fluid communication with the reservoir and the first bladder and configured to draw liquid from the reservoir and pump the liquid to the first bladder under pressure.

7. A toy gun in accordance with claim 6, wherein the pump is a dual-action pump having an internal piston and conduits attached thereto on either side of the piston such that movement of the piston in either direction causes liquid to be drawn from the reservoir and into the pump through one conduit and liquid to be pumped to the first bladder through to other conduit.

8. A toy gun in accordance with claim 1, comprising:

a housing having the second bladder disposed therein; and a carriage slidable on the exterior of the housing and engaged by the second bladder when the second bladder expands to slide away from the second valve, the carriage being operatively coupled to the second valve so that the second valve moves to the open position when the carriage slides away from the second valve.

9. A toy gun in accordance with claim 1, wherein the first valve comprises a snap action ball valve.

10. A toy gun in accordance with claim 1, wherein the second valve comprises a snap action ball valve.

11. A toy gun in accordance with claim 1, comprising a third valve having an inlet in fluid communication with the outlet of the first valve, a first outlet, and a second outlet in fluid communication with the second bladder, the third valve having a first position placing the inlet of the third valve in fluid communication with the first outlet such that the pressurized liquid from the first bladder is discharged through the first outlet, and a second position placing the inlet of the third valve in fluid communication with the second outlet such that the pressurized liquid from the first bladder is forced into the second bladder.

12. A toy gun for discharging pressurized liquid, comprising:

a pressurization mechanism providing a supply of pressurized liquid;

an elastomeric supply bladder in fluid communication with the pressurization mechanism and receiving pressurized liquid from the pressurization mechanism, wherein the supply bladder expands and the pressure within the supply bladder increases as the pressurized liquid is received by the supply bladder;

a trigger valve having an inlet in fluid communication with the supply bladder and being moveable between a closed position and an open position;

a mode selection valve having an inlet in fluid communication with the outlet of the trigger valve, a first outlet and a second outlet, the mode selection valve having a stream position placing the inlet of the mode selection valve in fluid communication with the first outlet and a pulse position placing the inlet of the mode selection valve in fluid communication with the second outlet;

an elastomeric pulse bladder in fluid communication with the second outlet of the mode selection valve; and a pulse valve having an inlet in fluid communication with the pulse bladder and an outlet, wherein the pulse valve is moveable between a closed position and an open position, and the pulse valve is operatively coupled to the pulse bladder such that expansion of the pulse bladder causes the pulse valve to move from the closed position to the open position, wherein, when the supply bladder is filled with pressurized liquid, the trigger valve is moved to the open position and the mode selection valve is in the stream position, pressurized liquid from the supply bladder is forced through the second outlet of the mode selection valve to discharge a continuous stream of liquid, and wherein, when the supply bladder is filled with pressurized liquid, the trigger valve is moved to the open position and the mode selection valve is in the pulse position, pressurized liquid from the supply bladder is forced into the pulse bladder, the pulse bladder expands as the pressurized liquid from the supply bladder is received, and the expansion of the pulse bladder causes the pulse valve to move to the open position such that the pressure within the pulse bladder causes a burst of liquid stored in the pulse bladder to discharge through the pulse valve.

13. A toy gun in accordance with claim 12, wherein the pulse valve moves from the open position to the closed position when the pulse bladder contracts due to the discharge of the burst of liquid.

14. A toy gun in accordance with claim 12, wherein the supply bladder is dimensioned to receive a volume of liquid with sufficient pressure to cause multiple bursts of liquid from the pulse bladder and pulse valve without supplying additional pressurized liquid from the pressurization mechanism to the supply bladder.

15. A toy gun in accordance with claim 14, wherein the toy gun discharges multiple bursts of liquid while the trigger valve remains open when the supply bladder contains a sufficient volume of pressurized liquid.

16. A toy gun in accordance with claim 12, wherein the pressurization mechanism comprises an inlet having a coupling configured to connect to an external source of pressurized liquid and a check valve allowing flow of liquid only in the direction from the coupling to the supply bladder.

17. A toy gun in accordance with claim 12, comprising a reservoir configured to receive a quantity of liquid, and wherein the pressurization mechanism comprises a pump in fluid communication with the reservoir and the supply bladder and configured to draw liquid from the reservoir and pump the liquid to the supply bladder under pressure.

18. A toy gun in accordance with claim 17, wherein the pump is a dual-action pump having an internal piston and conduits attached thereto on either side of the piston such that movement of the piston in either direction causes liquid to be drawn from the reservoir and into the pump through one conduit and liquid to be pumped to the supply bladder through to other conduit.

19. A toy gun in accordance with claim 12, comprising:

a pulse bladder housing having the pulse bladder disposed therein; and a carriage slidable on the exterior of the pulse bladder housing and engaged by the pulse bladder when the pulse bladder expands to slide away from the pulse valve, the carriage being operatively coupled to the pulse valve so that the pulse valve moves to the open position when the carriage slides away from the pulse valve.

20. A toy gun in accordance with claim 12, wherein the trigger valve comprises a snap action ball valve.

21. A toy gun in accordance with claim 12, wherein the pulse valve comprises a snap action ball valve.

22. A toy gun for discharging pressurized liquid, comprising:

an inlet port having a coupling configured to connect to an external source of pressurized liquid to the toy gun;

a trigger valve having an inlet in fluid communication with the inlet port and being moveable between a closed position and an open position;

an elastomeric pulse bladder in fluid communication with an outlet of the trigger valve; and a pulse valve having an inlet in fluid communication with the pulse bladder and being moveable between a closed position and an open position, the pulse valve being operatively coupled to the pulse bladder such that expansion of the pulse bladder causes the pulse valve to move from the closed position to the open position, and the elastomeric pulse bladder is not an integral component of the pulse valve, wherein, when an external source is connected to the coupling and providing pressurized liquid and the trigger valve is moved to the open position, pressurized liquid from the external source is forced into the pulse bladder, the pulse bladder expands as the pressurized liquid from the external source is received, and the expansion of the pulse bladder causes the pulse valve to move to the open position such that the pressure within the pulse bladder causes a burst of liquid stored in the pulse bladder to discharge through the pulse valve.

23. A toy gun in accordance with claim 22, comprising an elastomeric supply bladder in fluid communication with the inlet port and with the inlet of the trigger valve, wherein the supply bladder expands and the pressure within the supply bladder increases as the pressurized liquid provided by an external source connected to the coupling is received by the supply bladder, and wherein, when the supply bladder is filled with pressurized liquid and the trigger valve is moved to the open position, pressurized liquid from the supply bladder is forced into the pulse bladder to cause the discharge of a burst of liquid through the pulse valve.

24. A toy gun in accordance with claim 23, wherein the supply bladder is dimensioned to receive a volume of liquid with sufficient pressure to cause multiple bursts of liquid from the pulse bladder and pulse valve without supplying additional pressurized liquid to the pulse bladder.

25. A toy gun in accordance with claim 24, wherein the toy gun discharges multiple bursts of liquid while the trigger valve remains open when the pulse bladder contains a sufficient volume of pressurized liquid.

26. A toy gun in accordance with claim 23, comprising a reservoir configured to receive a quantity of liquid, a pump in fluid communication with the reservoir and the supply bladder and configured to draw liquid from the reservoir and pump the liquid to the supply bladder under pressure.

27. A toy gun in accordance with claim 26, wherein the pump is a dual-action pump having an internal piston and conduits attached thereto on either side of the piston such that movement of the piston in either direction causes liquid to be drawn from the reservoir and into the pump through one conduit and liquid to be pumped to the supply bladder through to other conduit.

28. A toy gun in accordance with claim 22, wherein the pulse valve moves from the open position to the closed position when the pulse bladder contracts due to the discharge of the burst of liquid.

29. A toy gun in accordance with claim 22, wherein the toy gun discharges multiple bursts of liquid while the trigger valve remains open and the external source is providing pressurized liquid.

30. A toy gun in accordance with claim 22, comprising:

a pulse bladder housing having the pulse bladder disposed therein; and a carriage slidable on the exterior of the pulse bladder housing and engaged by the pulse bladder when the pulse bladder expands to slide away from the pulse valve, the carriage being operatively coupled to the pulse valve so that the pulse valve moves to the open position when the carriage slides away from the pulse valve.

31. A toy gun in accordance with claim 22, wherein the trigger valve comprises a snap action ball valve.

32. A toy gun in accordance with claim 22, wherein the pulse valve comprises a snap action ball valve.

33. A toy gun in accordance with claim 22, comprising a mode selection valve having an inlet in fluid communication with the outlet of the trigger valve, a first outlet, and a second outlet in fluid communication with the pulse bladder, the mode selection valve having a first position placing the inlet of the mode selection valve in fluid communication with the first outlet such that the pressurized liquid from the trigger valve is discharged through the first outlet, and a second position placing the inlet of the mode selection valve in fluid communication with the second outlet such that the pressurized liquid from the trigger valve is forced into the elastomeric pulse bladder.

* * * * *